US006091032A

United States Patent [19]

Dohnal et al.

[11] Patent Number: 6,091,032

[45] Date of Patent: Jul. 18, 2000

[54] TAP CHANGER

[75] Inventors: Dieter Dohnal, Lappersdorf; Klaus Höpfl, Maxhütte-Haidhof; Silke Wrede, Zeitlarn, all of Germany

[73] Assignee: Maschinenfabrik Reinhausen GmbH, Regensburg, Germany

[21] Appl. No.: 09/164,468

[22] Filed: Oct. 1, 1998

[30] Foreign Application Priority Data

Oct. 4, 1997 [DE] Germany ..... 197 43 865

[51] Int. Cl.[7] ..... H01H 19/54

[52] U.S. Cl. ..... 200/11 TC; 200/17 R

[58] Field of Search ..... 200/1 R, 11 R, 200/12–14, 11 TC, 17 R, 18

[56] References Cited

U.S. PATENT DOCUMENTS

| | | | |
|---|---|---|---|
| 3,462,562 | 8/1969 | Norman | 200/11 |
| 3,612,786 | 10/1971 | Whitman | 200/11 TC |
| 3,875,354 | 4/1975 | Dusek | 200/11 TC |
| 4,978,815 | 12/1990 | Berger et al. | 200/11 TC |
| 5,107,200 | 4/1992 | Dohnal et al. | 323/340 |
| 5,834,717 | 11/1998 | Neumeyer et al. | 200/17 R |

FOREIGN PATENT DOCUMENTS

| | | | |
|---|---|---|---|
| 40 11 019 | 12/1991 | Germany | H01F 29/04 |

OTHER PUBLICATIONS

"Tab Changer Type RMV II", Reinhausen Manufacturing, Humboldt, USA, Brochure RM 05/19–1094/5000.

*Primary Examiner*—Michael Friedhofer
*Attorney, Agent, or Firm*—Herbert Dubno

[57] ABSTRACT

A tap changer has a bypass switch with a rotary pair of movable contacts engaging arc segmental fixed contacts of a length greater than the spacing between the movable contact which spacing is greater than the spacing between the fixed contacts of the bypass switch.

5 Claims, 4 Drawing Sheets

TAP CHANGER

FIELD OF THE INVENTION

Our present invention relates to a tap changer and, more particularly, to a tap changer operating in accordance with the reactor switching principle for interruption-free tap changing under load.

BACKGROUND OF THE INVENTION

A tap changer for interruption-free changing under load, e.g. the selection of taps on, for example, a power transformer may be used for voltage regulation in power distribution and generating systems. In such arrangements, a switchover impedance is provided which is effective during tap change operations to avoid short circuiting and overloading.

A tap changer of the type with which the invention is concerned is the load tap changer type RMV II of the firm Reinhausen Manufacturing, Humboldt, USA, and described in the brochure RM 05/91-1094/5000. A vacuum switching cell is here used for the switching under load.

More particularly, the system can comprise a pair of selector switches which are movable from tap to tap along the row of transformer taps of a load transformer. Each one of these switchover contacts is connected to a respective impedance, e.g. a coil. The opposite ends of the coils can be bridged by a vacuum switching cell and each of these impedances is also connected at the aforementioned opposite end with a fixed contact of a bypass switching arrangement. In addition to the fixed bypass contacts, the bypass switching system includes movable contacts which can be selectively operated so that both switches may be closed or each movable bypass contact may be in an open-circuit position while the other is closed. Depending upon the setting of the bypass switch, therefore, each of the two movable bypass contacts can be individually connected with the load line or conductor or both of the movable contacts can be connected in common to the load line or can connect the load line in common to their respective fixed contacts. For this purpose, the system has required two fixed bypass contacts and two movable bypass contacts, the movable bypass contacts being linked together and with the load conductor.

In a stationary state, the bypass switch connects the load line L in common with the two fixed bypass contacts. At the beginning of a tap change under load, this connection between the two fixed bypass contacts via the movable bypass contacts is interrupted so that, for example, one of the bypass contacts is opened when the vacuum cell switch is closed for the beginning of switchover. The bypass switch thus does not have to break under load. The vacuum switching cell can then open circuit, whereupon a selector contact can be moved from one tap to the other whereupon the vacuum switching cell is then closed and the bypass contact can then close. The other bypass contact can then open and the process repeated until the second selector contact is on the successor tap. The bypass switch with this functioning is described, for example, in German patent 40 11 019.

A bypass switch system of this type has numerous drawbacks. The link mechanism which connects the bypass contact electrically as well as mechanically and provides their coupled movement is complex and expensive to fabricate. The same applies for the fixed bypass contacts which must be held in a frame and are constituted by individual lamella. If the current capacity is to be high, both the fixed and movable contacts are comparatively large which is also undesirable.

OBJECTS OF THE INVENTION

It is, therefore, the principal object of the present invention to provide a tap changer operating in according with the principles set forth above with an improved construction of the bypass switch.

Another object of this invention is to provide a bypass switch for such a system which is of simpler construction and can be actuated more easily and simply than earlier bypass switches for the purpose.

Yet another object of the invention is to provide a bypass switch arrangement for a tap changer operating under the principles described, whereupon a high current carrying capacity can be obtained with relatively small dimensions of the contacts.

SUMMARY OF THE INVENTION

These objects and others which will become apparent hereinafter are attained, in accordance with the invention, in a tap changer which comprises:

two movable switchover contacts in circuit with respective impedances and shiftable from joint engagement with one tap, to separate engagement with a successive tap and to joint engagement with the successive tap;

a respective fixed bypass contacts in series with each of the movable switchover contacts and the respective impedance; and a pair of movable bypass contacts connected to a load conductor, displaceable by a common member and shiftable selectively between a position in which both of the movable bypass contacts connect the load conductor to the respective fixed bypass contacts, and positions in which each of the movable bypass contacts connects the load conductor to the respective fixed bypass contact independently of the other movable bypass contact, the member being a common carrier for the movable bypass contacts rotatable by a shaft, each of the fixed bypass contacts being a circular arc segment of a length a along a circle centered on an axis of the shaft and separated by a distance b, the movable bypass contacts being separated by a distance c along the circle such that a is greater than c and b is less than c.

The tap changer of the invention utilizes a contact carrier rotatable on a shaft and on which the movable bypass contacts are mounted with a fixed spacing c from one another. and the two fixed bypass contacts can be engaged by these movable contacts. The two fixed bypass contacts are located on a circle and have the configuration of segments with a segment length a which is greater than the distance c. A spacing b between the fixed contacts is smaller than the spacing c between the movable bypass contacts. The movable bypass contacts may also ride upon a slip ring, which may extend over a segment of a circle, and the fixed bypass contacts can be symmetrical about a plane of symmetry perpendicular to the direction of movement of the movable bypass contacts.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
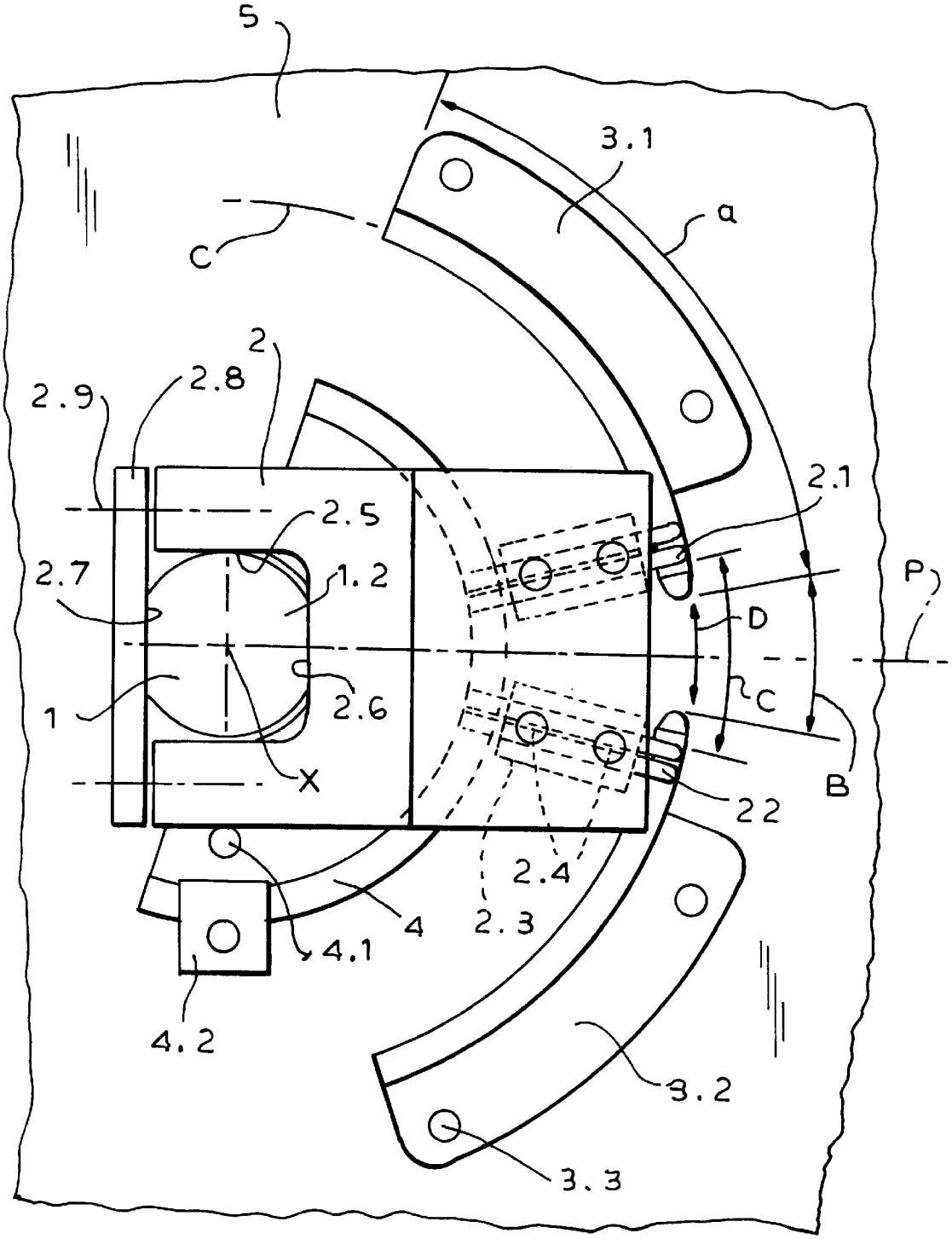
FIG. 1 is an elevational view of a bypass switch for the tap changer of the invention.

The bypass switch shown in FIGS. 1–4 comprises a shaft 1 having flats 1.1 and 1.2 which are engaged by walls 2.6, 2.7 of a carrier 2 having a recess 2.5 in which the shaft is clamped by 5 a plate 2.8 and screws represented diagrammatically at 2.9 (FIG. 1). The carrier 2 has holders 2.3 attached to it by screws 2.4 (see FIG. 4) each of which receives a pair of contact bars forming the movable bypass contacts 2.1 and 2.2. The relative positions of these contacts on the carrier 2 are fixed so that 10. the distance between the movable contacts can be represented at C.

The fixed contacts 3.1 and 3.2 are connected by screws 3.3 to the insulating plate 5, through which the shaft 1 passes.

These contacts 3.1 and 3.2 are symmetrical about symmetry plane P which is perpendicular to the direction of displacement of the movable contacts 2.1, 2.2 represented by the double-headed arrow D in FIG. 1.

The fixed contacts 3.1 and 3.2 are circular arc segments disposed along a circle c centered on the axis X of the shaft 1 and are spaced apart by a distance b along that circle. The arc lengths of the contacts 3.1 and 3.2 along that circle are represented by the distance a.

According to the invention, the lengths a of the segmental contacts 3.1 and 3.2 and the spacing b between them along the circle C are respectively greater than and less than the distance c along the circle between the movable contacts 2.1 and 2.2.

The movable contacts are bars which bridge between the segmental contacts 3.1 or 3.2 and a slip ring 4 which is also of segmental form and is attached by screws 4.1 to the insulating plate 5. A terminal 4.2 connects the slip ring 4 to a line L.

Figure 2:
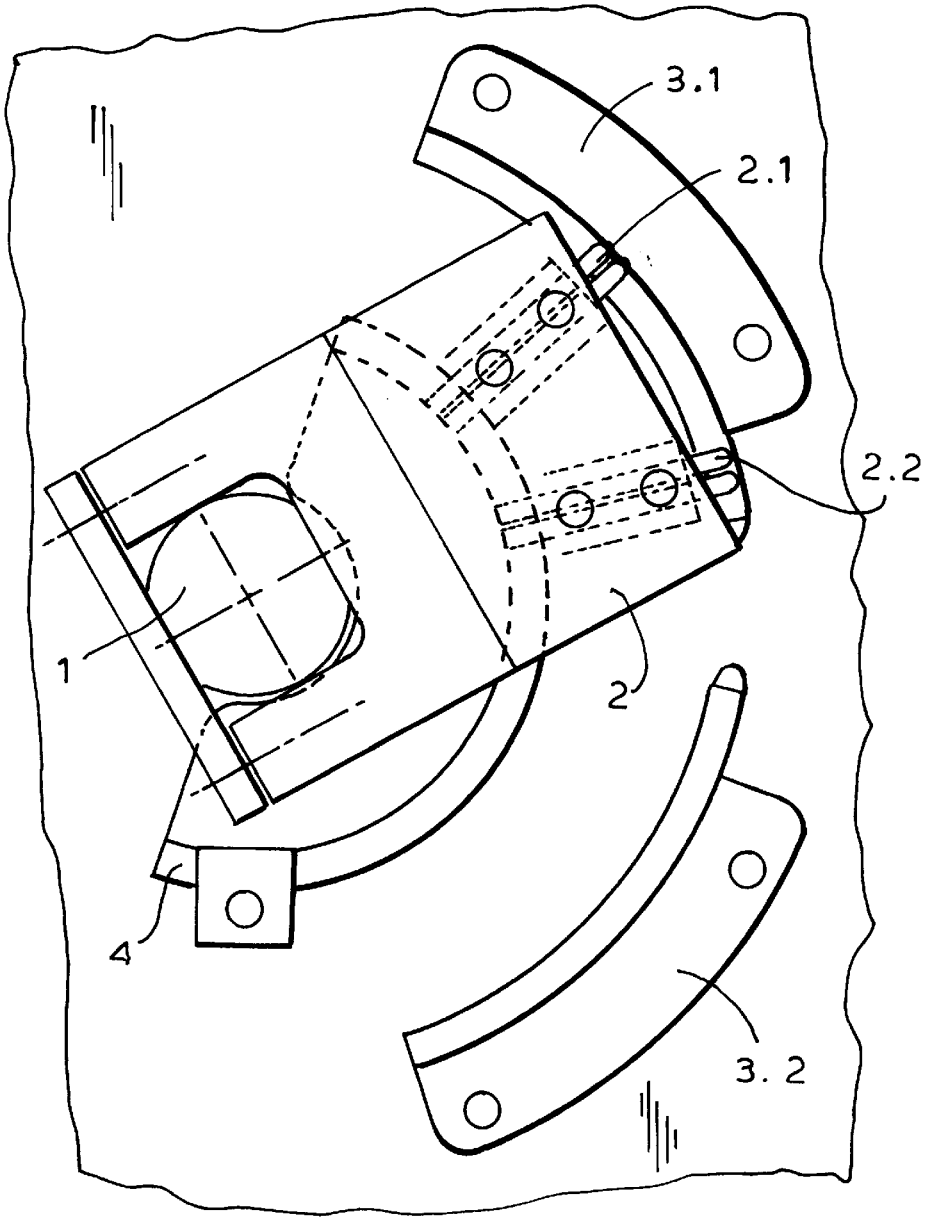
FIG. 2 is a view similar to FIG. 1 with the bypass switch in another position.
Figure 4:
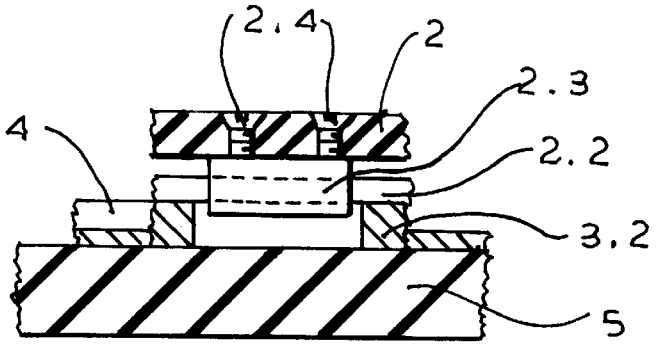
FIG. 4 is a cross sectional view through the switch of FIGS. 1 and 2.
Figure 3C:
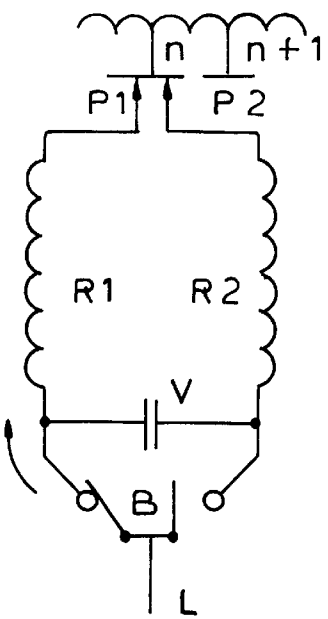
FIGS. 3*a*–3*f* are circuit diagrams showing different stages in the operation of the tap changer, FIGS. 3*a*–3*f* representing a prior art switching approach which can be embodied in the use of the bypass switch of FIGS. 1 and 2.
Figure 3B:
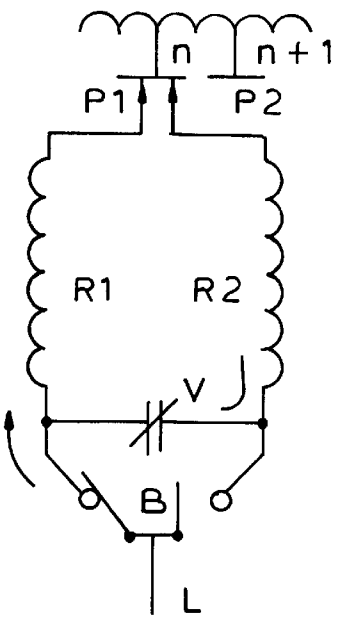
Figure 3A:
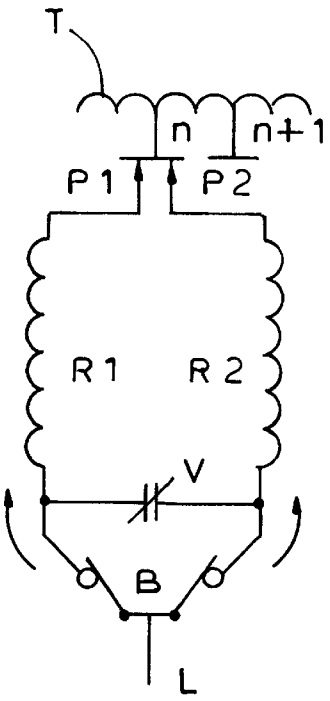
Figure 3F:
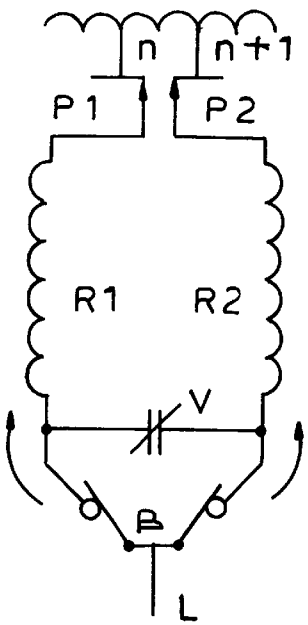
Figure 3E:
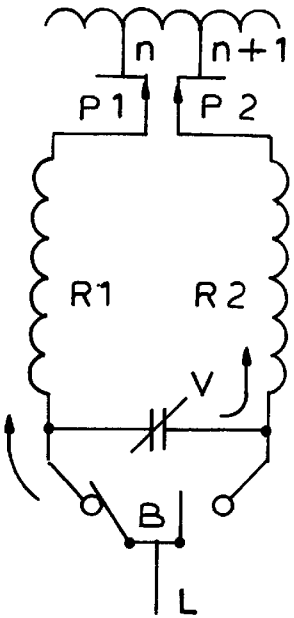

As can be seen from FIG. 2, the movable bypass contacts may both engage one or the other of the segments 3.1 and 3.2 (FIG. 2) or each may engage a respective segment 3.1, 3.2 (FIG. 1) when the bypass switch is in the position shown in FIGS. 3*a* and 3*f* for example, In the position shown in FIG. 2, with both movable contacts engaged with one of the fixed contacts 3.1, the bypass switch is in the position shown in FIGS. 3*b*–3*e*.

The bypass contacts 2.1 and 2.2 can be easily replaced on the carrier 2 by removal of the screws 2.4 for substituting contacts of different lengths or widths or contacts of other materials without disturbing the relationship between a, b and c.

FIGS. 3*a*–3*f* show the sequence for the one tap change. In these Figures, one transformer tap or a load transformer tap T is represented at n and the next tap is n+1. The selector contacts are represented at P1, P2 and are connected each to one end of an inductive impedance R1, R2 shown as a coil. The opposite ends of those impedances are bridged by a vacuum switching cell V as has become standard in the tap changer art. Also connected to these opposite ends of the impedances R1 and R2 are segments 3.1 and 3.2 of the bypass switch here represented at V and shown to be connected to the load line or conductor L.

Figure 3D:
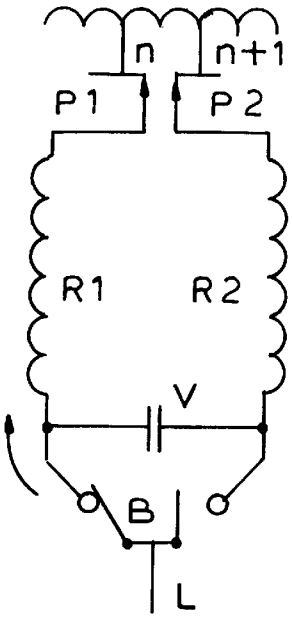

As will be apparent from FIGS. 3*a*, in the stationary state, the vacuum switching cell V can be closed, both of the movable contacts of the bypass switch can be connected to the respective segments (FIG. 1) and the two switchover contacts P1, P2 are connected to the previous tap n. With the cell V closed, one of the segments can be open-circuited by the bypass switch B (FIG. 2) to yield the state shown in FIG. 3*b* so that, with the cell V conducting, there is no sparking on the open circuiting of the segment 3.2 for example, The vacuum switching cell V is then open-circuited, (FIG. 3*c*) so that impedance R2 is not under load and the switchover to the next tap n+1 can be effected (FIG. 3*d*). The vacuum switching cell V is then closed (FIG. 3*e*) so that impedance R2 is again under load, whereupon the bypass switch B can be returned to the state shown in FIG. 1 which corresponds to the position shown in FIG. 3*f*. The process can then be repeated in this sequence with the other bypass switch segment open-circuited so that contact P1 can be moved to the tap n+1.

We claim:

1. A tap changer for interruption-free switchover between taps under load of a transformer, said tap changer comprising:

two movable switchover contacts in series with respective impedances and shiftable successively from joint engagement with a first one of said taps, to separate engagement with a successive one of said taps and to joint engagement with, said first tap and said successive tap;

a respective fixed bypass contact in series with each of said movable switchover contacts and the respective impedance;

a pair of movable bypass contacts connected to a load conductor, displaceable by a common member and shiftable selectively between a position in which both of said movable bypass contacts connect said load conductor to a respective fixed bypass contacts, and positions in which each of said movable bypass contacts connects said load conductor to the respective fixed bypass contact independently of the other movable bypass contact, said member being a common carrier for said movable bypass contacts rotatable by a shaft, each of said fixed bypass contacts being a circular arc segment of a length a along a circle centered on an axis of the shaft and separated by a distance b, said movable bypass contacts being separated by a distance c along said circle such that a is greater than c and b is less than c, each of said impedances being a respective coil connected at one end to a respective switchover contact and at an opposite end to the a respective fixed bypass contact; and a vacuum switching cell connected between said opposite ends of said coils and bridging said coils in a closed condition of the vacuum switching cell.

2. The tap changer defined in claim 1 wherein said load conductor is at least a segment of a circular slip ring centered on said axis, said slip ring and said fixed bypass contacts each being engaged by respective ends of said movable contacts.

3. The tap changer defined in claim 2 wherein said fixed bypass contacts are symmetrical about a plane of symmetry perpendicular to a direction of movement of said movable contacts.

4. The tap changer defined in claim 3 wherein each of said movable bypass contacts comprises a pair of bars bridging between said slip ring and said fixed bypass contacts.

5. The tap changer defined in claim 1 wherein said fixed bypass contacts are symmetrical about a plane of symmetry perpendicular to a direction of movement of said movable bypass contacts.

* * * * *